US008683638B2

(12) United States Patent
Montabaur

(10) Patent No.: US 8,683,638 B2
(45) Date of Patent: Apr. 1, 2014

(54) ROTARY TOOL

(75) Inventor: Werner Montabaur, Konigswinter (DE)

(73) Assignee: MONTI-Werkzeuge GmbH, Bonn (DE)

( * ) Notice: Subject to any disclaimer, the term of this patent is extended or adjusted under 35 U.S.C. 154(b) by 2119 days.

(21) Appl. No.: 11/345,614

(22) Filed: Feb. 1, 2006

(65) Prior Publication Data

US 2006/0174432 A1 Aug. 10, 2006

(30) Foreign Application Priority Data

Feb. 3, 2005 (DE) ..... 10 2005 005 178
Mar. 4, 2005 (DE) ..... 10 2005 009 854

(51) Int. Cl.
*A46B 13/06* (2006.01)

(52) U.S. Cl.
USPC ..... 15/23; 15/387

(58) Field of Classification Search
USPC ..... 15/240, 21.1, 23, 50.3, 387, 24; 451/449, 450, 488
See application file for complete search history.

(56) References Cited

U.S. PATENT DOCUMENTS

| | | | | | |
|---|---|---|---|---|---|
| 1,679,323 | A | * | 7/1928 | Mortlock | 15/29 |
| 2,599,952 | A | * | 6/1952 | Strayer | 451/449 |
| 3,110,993 | A | * | 11/1963 | Grage | 451/450 |
| 3,591,989 | A | | 7/1971 | Granlie | |
| 4,292,770 | A | | 10/1981 | Newton | |
| 5,072,475 | A | * | 12/1991 | Rubiano | 15/3 |
| 5,524,315 | A | | 6/1996 | Montabaur | |
| 5,649,508 | A | * | 7/1997 | Rost et al. | 222/191 |
| 7,115,018 | B1 | * | 10/2006 | Syverson | 451/6 |
| 7,144,312 | B2 | * | 12/2006 | Boyle | 451/449 |

FOREIGN PATENT DOCUMENTS

| | | |
|---|---|---|
| DE | 43 26 793 | 9/1994 |
| EP | 0 691 181 | 1/1996 |
| FR | 2002217 | 2/1969 |

* cited by examiner

*Primary Examiner* — Dung Van Nguyen
(74) *Attorney, Agent, or Firm* — Andrew Wilford

(57) ABSTRACT

The subject of the present invention is a rotary tool (1) for surface treatment. This is equipped with a brush holder (3) which can be driven in rotation for an annular brush (4) with a brush strip (5) and bristles (6) protruding outwardly from the brush strip (5). According to the invention, coolant for the cooling thereof is supplied to the brush holder (3) and/or the annular brush (4).

7 Claims, 2 Drawing Sheets

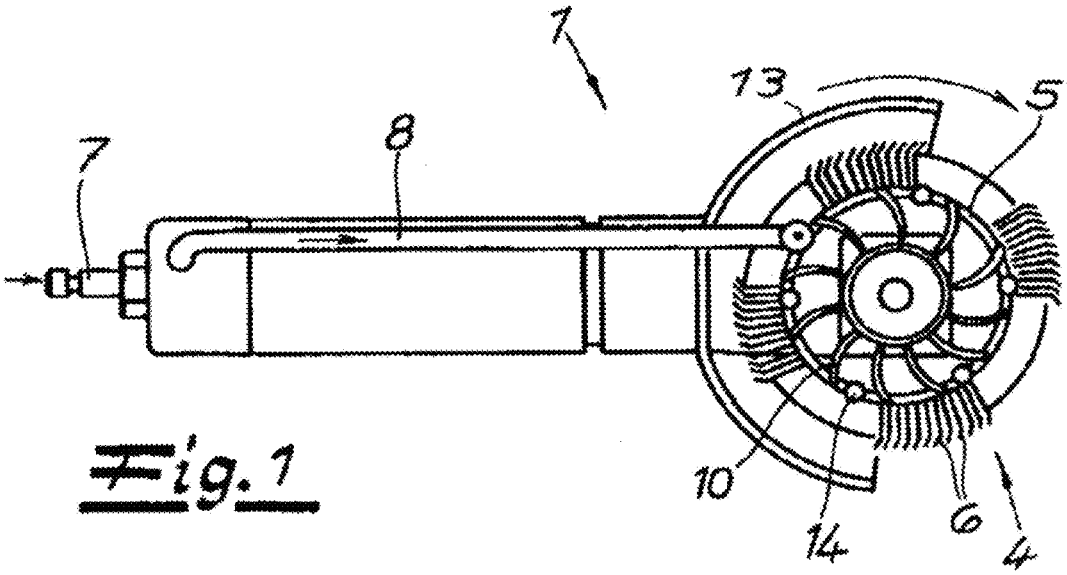
Fig. 1
Fig. 2
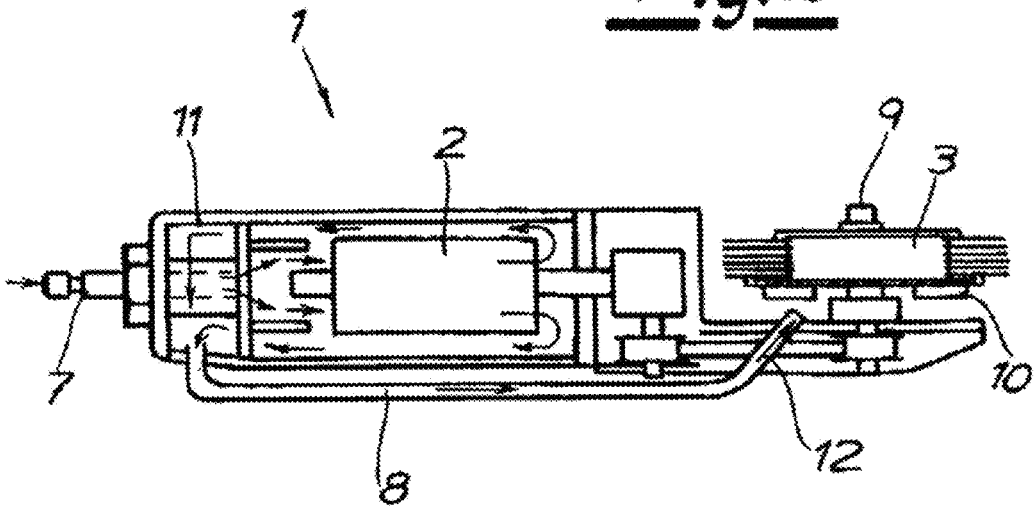

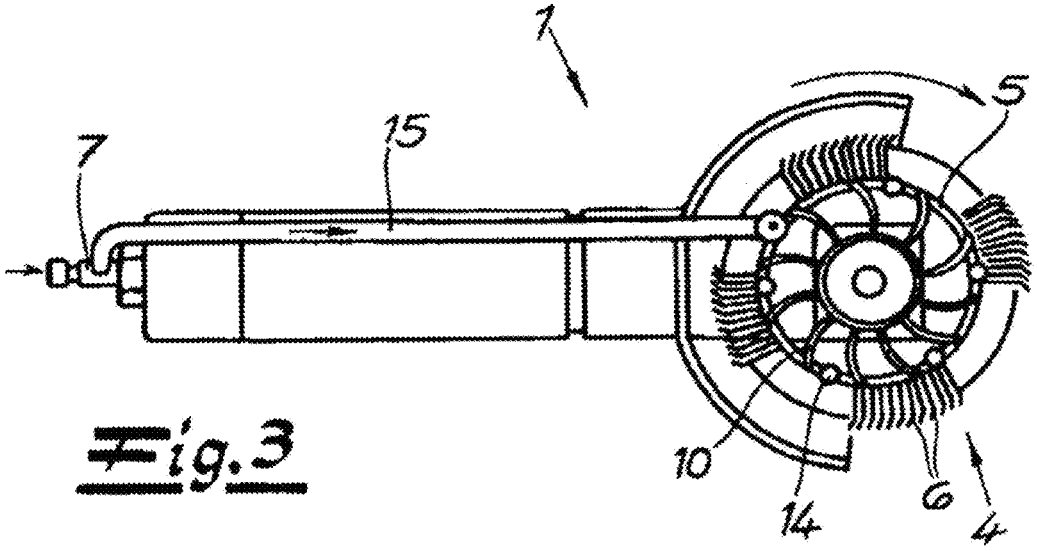
Fig. 3
Fig. 4
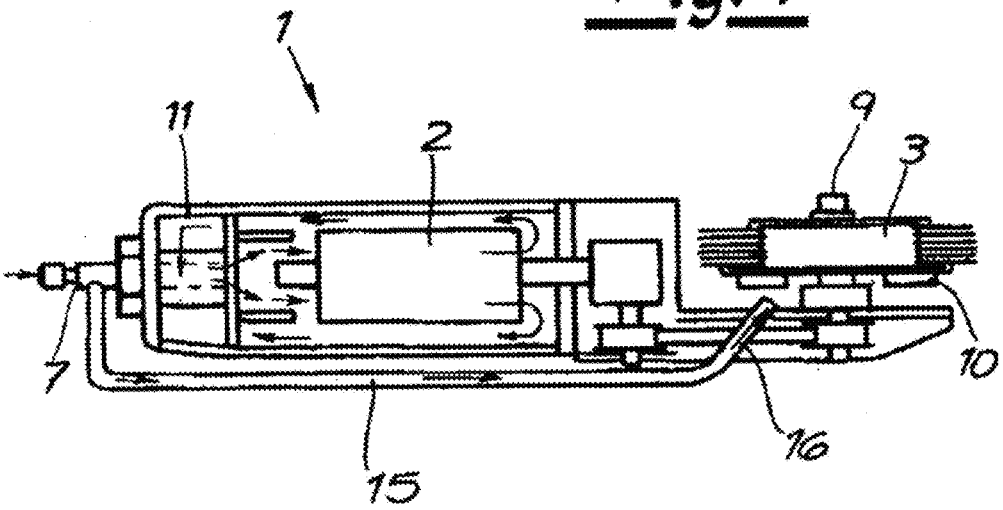

ROTARY TOOL

FIELD OF THE INVENTION

The invention relates to a rotary tool for surface treatment, with a brush holder which can be driven in rotation and that carries an annular brush with a brush strip and bristles protruding outwardly from the brush strip. Such rotary tools are used as hand-held tools, in particular for paint removal, corrosion and underbody protection removal and for roughening metallic surfaces.

BACKGROUND OF THE INVENTION

A rotary tool of the above-described configuration is disclosed, for example, in DE 43 26 793 C1 (U.S. Pat. No. 5,524,315). The subject thereof is to ensure intensive surface treatment and moreover to achieve increased service life.

Notwithstanding this, a polishing tool driven by compressed air is known from EP 0 691 181 B1, which nevertheless is not equipped with a brush holder for an annular brush with a brush strip. Instead, a polishing pad is driven in rotation. Additionally, a cooling air passage is used for injecting air through an air passage in a motor rotary shaft into the central part of the polishing working surface.

Deploying the above-described rotary tools with annular brushes results in a rise in temperature at peak load not only of the bristles and the brush strip but also the tool holder and/or brush holder which generally consist of steel, aluminum or another metal. As a result, the durability, in particular of the rolling brush strip rapidly reduces, so that it may not only lead to premature wear of the bristles but also to premature damage and finally tearing of the brush strip.

OBJECT OF THE INVENTION

The object of the invention is to provide a rotary tool of the above-described embodiment which is characterized by increased durability in a simple and functional manner, even at peak load.

SUMMARY OF THE INVENTION

To achieve this object, with a generic rotary tool for surface treatment, the invention teaches that coolant is supplied to the brush holder and/or annular brush for the cooling thereof. This proves to be particularly advantageous in view of the fact that the brush strip is, in particular, made from polyamide fabric and the bristles are preferably wire bristles.

According to an embodiment of the invention the coolant may be supplied by means of a cooling device which is separate from the rotary tool. According to a further embodiment, the coolant may be supplied by means of a cooling device connected to the rotary tool or integrated within the rotary tool. The cooling device may be a coolant cartridge. A gaseous medium, for example air, or a liquid medium, for example water, may be supplied as coolant. The brush strip, its bristles and optionally also the tool holder and/or brush holder are always cooled to such an extent, that even at peak load the above-described tool elements are no longer subjected to such heating which can subsequently result in the damage thereof. This applies in particular to the heated brush strip and/or the carrier fabric thereof which is made, for example, from polyamide and which, with loop formation, is under high mechanical stress, as a result of the rotation. Cooling the rotating brush strip reduces the deformation thereof and prevents the strip from tearing. As a result, the durability of the rotary tool according to the invention and in particular of its tool elements is quite considerably increased and namely in a simpler and more functional manner.

The rotary tool can be driven in various modes of operation, for example electrically. An embodiment with a pneumatic drive is, however, preferred. In this case, two alternatives have proved advantageous to provide coolant for the required cooling of the brush holder and/or the annular brush. On the one hand, exhaust air from the pneumatic drive can be supplied as coolant to the brush holder and/or the annular brush, in particular to the brush strip and optionally the bristles. On the other hand, there is the possibility of diverting a fresh air line from a compressed air supply for the pneumatic drive and to direct its outlet end toward the brush holder and/or the annular brush, in particular the brush strip. In detail, the fresh air line and/or its outlet end may be fitted to this end with a fresh air outlet nozzle, the fresh air line being guided as far as the region of the brush holder and the fresh air outlet nozzle being directed toward the brush holder and/or the annular brush and in particular the brush strip.

Within the context of the first alternative, the exhaust air of the pneumatic drive is supplied for cooling via an exhaust air line to the brush holder and/or the annular brush arranged on the brush holder and in this case in particular the brush strip thereof. These measures of the invention have the result that the exhaust air of the pneumatic drive is entirely used for cooling the tool and as a result, in particular, the brush strip. In this connection, the invention is based on the recognition that the exhaust air generally escaping toward the rear or, more precisely, outwardly, is collected and can be guided back outside the rotary tool toward the front to the tool driven in rotation or, more precisely, the annular brush with the brush strip and wire bristles. Naturally, it is also conceivable to move the exhaust air line into the interior of the rotary tool.

In the second alternative, however, the fresh air diverted from the compressed air supply is used for cooling the annular brush and in this case in particular the brush strip. In this connection in both cases it is provided, according to a proposal with independent meaning, that the tool holder and/or brush holder is equipped with turbine blades on the fresh air side or exhaust air side, i.e. on the side on which the fresh air or exhaust air is supplied for cooling. Equally usefully, it is possible to arrange a turbine-like blade wheel on a rotational is axis of the brush holder and to admit fresh air or exhaust air or the similarly conceivable separately supplied coolant. The same applies to the turbine blades.

As a result, the energy of the fresh air diverted from the compressed air supply for the pneumatic drive and diverted toward the turbine blades and/or the blade wheel and to the brush holder and annular brush is fully utilized. A torque assistance, as it were, is provided on the brush holder which is driven in rotation via the turbine blades and/or the turbine wheel. The same applies to the exhaust air flowing out from the pneumatic drive and diverted toward the turbine blades and/or blade wheel, in addition to the brush holder and the brush strip and which is similarly fully utilized in order to cool by using exhaust air. Naturally, the disclosed cooling using exhaust air can also be combined with cooling using fresh air. It is also conceivable to vary the respective components. As the fresh air generally has a lower temperature than the exhaust air, where there is a high cooling requirement cooling is carried out substantially using fresh air and vice versa.

Insofar as the tool driven in rotation and, in particular, the annular brush is at least partially enclosed by a protective cover, this protective cover comprises through holes for the supply and removal of fresh air or exhaust air and can also be used for cooling the front face of the brush strip and its bristles. Furthermore, there is the possibility of installing a cooling device such as for example a coolant cartridge, for example an air cartridge. Preferably an exhaust air collection device, for example the exhaust air cover, is associated with the pneumatic drive on the exhaust air side and the exhaust air line is attached to this exhaust air collection device. Furthermore, the invention provides that the exhaust air line has an exhaust air outlet nozzle at the outlet end, which is oriented specifically toward the turbine blades and/or the blade wheel and the brush holder with the annular brush. Preferably, fresh air or exhaust air is blown by the turbine blades along the width of the brush holder and the annular brush at a predetermined angle of inclination.

BRIEF DESCRIPTION OF THE DRAWING

The invention is described in more detail hereinafter with reference to drawings showing merely one embodiment, in which:

FIG. 1 is a diagrammatic lateral view of the rotary tool according to the invention, FIG. 2 is a plan view of the tool according to FIG. 1 with the protective cover removed and the tool housing partially removed, FIG. 3 is a modified embodiment of the tool according to FIG. 1 with a fresh air line, and FIG. 4 is a plan view of the tool according to FIG. 1 with the protective cover removed and the tool housing partially removed.

SPECIFIC DESCRIPTION

A rotary tool 1 for surface treatment is shown in FIGS. 1 and 2, which in its basic construction comprises a pneumatic drive 2 having a shaft 9 carrying a tool holder 3 which can be driven in rotation, according to the embodiment a brush holder 3, for an annular brush 4 with a brush strip 5 and bristles 6 protruding outwardly from the brush strip 5. The bristles 6 are, in particular and in a non-limiting manner, wire bristles. Furthermore a compressed air supply 7 is provided for the pneumatic drive 2.

According to a first alternative, as FIGS. 1 and 2 show, the exhaust air of the pneumatic drive 2 is supplied via an exhaust air line 8 to the brush holder 3 and/or the annular brush 4 with the bristles 6, as coolant for the cooling thereof. At the same time, the exhaust air provides torque assistance for the brush holder 3 driven in rotation. To this end, the brush holder 3 on the exhaust air side, i.e. facing an outlet end of the exhaust air line 8 on the exhaust air side and/or an exhaust air nozzle 12 there, is equipped with turbine blades 10, which also, i.e. in addition to the brush holder 3 and/or the annular brush 4, are impinged upon by exhaust air. As a result, the energy of the exhaust air flowing out of the exhaust air line 8 as disclosed is utilized as torque assistance for the brush holder 3 driven in rotation.

Moreover, an exhaust air collection device 11 is associated with the pneumatic drive 2 in the region of an exhaust air inlet, i.e. on the side of the exhaust air outlet of the pneumatic drive 2, which by way of example and in a non-limiting manner is configured as an exhaust air collection cover. The exhaust air line 8 is attached to this exhaust air collection device 11 which within the context of the embodiment is supplied on the exterior of the rotary tool 1 and/or a corresponding housing for the brush holder 3 with the annular brush 4 and the turbine blades 10. On the outlet end of the exhaust air line 8 is provided the above-described exhaust air nozzle 12 and/or exhaust air outlet nozzle which is directed toward the turbine blades 10 and toward the brush holder 3 with the annular brush 4 received thereby.

The tool assembly shown in FIGS. 1 and 2 is entirely enclosed by a protective cover 13 partially indicated in FIG. 1, which similar to a flange for the brush holder 3, which is driven in rotation, is equipped with through holes 14 for the supply and removal of exhaust air. With reference to the sectional view in FIG. 1, it can finally be seen that the pneumatic medium supplied via the compressed air supply 7 to the pneumatic drive 2, in the example compressed air, is diverted by approximately 180° in the housing of the rotary tool 1 after passing through the pneumatic drive 2 and then, as it were, guided back toward the compressed air supply 7. The exhaust air collection device 11 is provided at this end on the exhaust air outlet side of the pneumatic drive 2, and which collects the exhaust air and transfers it into the exhaust air line 8.

A fresh air line 15 diverted from the compressed air supply 7 is present in the modified embodiment shown in FIGS. 3 and 4. At its outlet end for the fresh air, the fresh air line 15 uses a fresh air (outlet) nozzle 16 which is guided as far as the region of the brush holder 3 and directed toward the brush holder 3 and/or the annular brush 4 and provides the cooling thereof by means of fresh air as coolant. In either case, the brush strip 5, in particular, is cooled. This means both the fresh air outlet nozzle 16 and the exhaust air outlet nozzle 12 are preferably directed toward the brush strip 5 with its bristles 6, both the exhaust air and the fresh air flowing obliquely to the brush strip 5, i.e. at an angle of approximately 45° relative to the longitudinal extension in plan view. The above-described angle of approximately 45° is also enclosed between the width of the brush strip 5 and the respective nozzle 12, 16. As a result, the turbine blades 10 are correspondingly impinged upon where they are attached to the brush holder 3 on the exhaust air and/or fresh air side—for torque assistance. The same applies to any turbine wheel provided here.

Within the scope of the invention, there is also the possibility of supplying the exhaust air of the pneumatic drive 2 directly as coolant to the annular brush 4 and/or the brush strip 5 thereof and also the bristles 6. In this case, no exhaust air line 8 is present but after its exit from the pneumatic drive 2 the exhaust air is immediately directed toward the brush holder 3 and/or the annular brush 4 and in particular the brush strip 5 via an interpositioned diverting device, not shown.

The invention claimed is:

1. A rotary tool for abrasive surface treatment, the tool comprising:

a rotatable drive shaft;

a rotatable brush holder fixed on the shaft;

an annular brush on the brush holder and having a brush strip and bristles protruding outwardly from the brush strip;

a pneumatic drive connectable to a compressed-air supply and connected to the drive shaft and therethrough to the holder for rotating same; and means for feeding compressed air at least indirectly from the supply to the brush holder or the annular brush for cooling same.

2. The rotary tool according to claim 1 wherein the compressed-air supply is an air cartridge.

3. The rotary tool according to claim 1, further comprising an exhaust air collection device associated with the pneumatic drive on an exhaust air side.

4. The rotary tool defined in claim 1 wherein the pneumatic drive has an outlet from which air is vented after passing from the supply through the drive.

5. The rotary tool defined in claim 4 wherein the outlet is connected to the means for feeding for supplying cooling air thereto.

6. The rotary tool defined in claim 4 wherein the means for feeding is a conduit connected generally to the supply.

7. The rotary tool defined in claim 4, further comprising turbine blades on a side of the brush holder impinged upon by fresh air or exhaust air.

* * * * *